United States Patent [19]

Halford et al.

[11] 4,296,513

[45] Oct. 27, 1981

[54] SEAT AND WAIST LASTING MACHINE-INDEPENDENTLY PIVOTABLE SIDE LASTING FINGERS

[75] Inventors: David W. Halford; Frank C. Price; George H. Bosworth, all of Leicester, England

[73] Assignee: USM Corporation, Farmington, Conn.

[21] Appl. No.: 134,459

[22] Filed: Mar. 27, 1980

[30] Foreign Application Priority Data

Apr. 21, 1979 [GB] United Kingdom ..... 13952/79

[51] Int. Cl.[3] ..... A43D 21/00

[52] U.S. Cl. ..... 12/12

[58] Field of Search ..... 12/12, 10.1, 10.2, 10.21, 12/10.3, 10.4, 145

[56] References Cited

U.S. PATENT DOCUMENTS 3,178,742 4/1965 Vollhardt et al. ..... 12/12

3,434,169 3/1969 Teerling et al. ..... 12/12

*Primary Examiner*—Patrick D. Lawson

*Attorney, Agent, or Firm*—Donald N. Halgren

[57] ABSTRACT

A shoe side or combined heel seat and side lasting machine has two side lasting assemblies, each comprising wiping elements mounted for pivotal movement, independently of adjacent elements, about first and second axes extending respectively transversely and lengthwise of the last bottom. For providing a substantially continuous wiping surface, the first axis lies in the plane of the work-engaging surface of its associated element, along the longitudinal center line thereof, when said surface lies horizontally. Also each shoe lasting assembly can pivot bodily about an axis adjacent the edge of the work-engaging surface of the most heelwardly disposed element, in the plane of its work-engaging surface. Associated with each pair of wiping elements is a clamp pad, said pad being caused clampingly to engage the shoe, while the inwiping movement of the elements continues, by operation of a common piston-and-cylinder arrangement.

16 Claims, 4 Drawing Figures

SEAT AND WAIST LASTING MACHINE-INDEPENDENTLY PIVOTABLE SIDE LASTING FINGERS

BACKGROUND OF THE INVENTION (1) Field of the Invention

This invention is concerned with shoe machines, more especially shoe machines for use in the lasting of side portions of shoe uppers, or shoe machines for use in the lasting of heel seat and side portions of shoe uppers.

(2) Prior Art

Articulated shoe lasting machines have taken a variety of forms in the prior art. They are embodied in U.S. Pat. No. 3,685,072 and U.K Pat. Nos. 1,339,875; 1,040,882; 355,817; 246,582; and 1,011,730. These patents represent machines having particular characteristics.

One such machine comprises a support for a shoe last on which an upper, the side portions of which are to be lasted, and an insole positioned, has two side lasting assemblies arranged so as to act on opposite side portions of an upper placed on a last supported by said support. Each side lasting assembly comprises a plurality of wiping elements arranged side-by-side so as to engage a corresponding side portion of the upper along the length thereof, said elements being movable inwardly so as to wipe the upper portion engaged thereby over the insole margin and to press it thereagainst.

Further in that machine, the wiping elements of each side lasting assembly are mounted in pairs, each pair being carried by a forked member which is itself mounted for limited pivotal movement, independently of the forked member(s) adjacent thereto, about a first axis extending transversely of the last bottom. Each pair of wiping elements can to some degree conform to the contour to the shoe bottom being operated upon. In addition, each wiping element is mounted for limited pivotal and heightwise movement, independently of the other element, such pivotal movement being about a second axis extending lengthwise of the shoe bottom, whereby each wiping element can conform to the widthwise curvature of the last bottom. Still further in the prior art, each side lasting assembly of the machine is mounted for bodily pivotal movement about a third axis extending transversely of the last bottom, in the plane of the heel seat region of such last bottom. Thus, when the side lasting assemblies are provided in a combined heel seat and side lasting machine, the axis extends in the plane of the work-engaging surface of the heel seat wiper members of the machine, through the edge, adjacent the assemblies, of said members.

By the arrangement described above, it is intended to accommodate the side lasting assemblies to the contour of the last bottom or style of shoe being operated upon, without the necessity for changing the side lasting assemblies, or the wiping elements thereof, while maintaining a substantially continuous wiping surface in the side regions of the shoe.

It will however, be appreciated that, by mounting the wiping elements in pairs as aforesaid, and pivoting them as a pair, the elements can only approximate the contour of the shoe bottom being operated upon. Especially in the case of a high-heeled shoe, where the curvature of the shoe bottom changes from concave to convex, the wiping elements mounted in pairs may be inadequate to provide a substantially continuous wiping surface.

In another prior art machine, the wiping elements are connected independently of one another to a mounting, by means of two ball-and-socket connections. The connections facilitate limited pivotal movement of each wiping element, independently of the element adjacent thereto, about first and second axes extending respectively transversely and lengthwise of the last bottom. In this prior art machine however, the first axis, extending transversely of the last bottom, passes through the second axis, with the result that the plane of the work-engaging surface of the wiping element is spaced apart from the second axis. This arrangement however, despite each wiping element being provided with shaped sides for accommodating pivotal movement about said first axis, permits pivotal movement which may be hampered by adjacent wiping elements "binding" on each other. Further pivoting movement tends to militate against providing a continuous wiping surface.

It is an object of the present invention to provide an improved shoe lasting machine for the use in the lasting of side portions of shoe uppers, in which the geometric arrangement of the wiping elements of side lasting assemblies thereof can be readily adapted to the contour of the shoe bottom being operated upon, while presenting a substantially continuous wiping surface thereto.

BRIEF SUMMARY OF THE INVENTION

The present invention discloses a shoe lasting machine for use in the lasting of side portions of shoe uppers comprising a support for a shoe last on which an upper, the side portions of which are to be lasted, and an insole are positioned, and two side lasting assemblies arranged so as to act on opposite side portions of the upper placed on the last supported by said support. Each side lasting assembly comprises a plurality of wiping elements arranged side-by-side so as to engage a corresponding side portion of the upper along the length thereof, said elements being movable inwardly so as to wipe the upper portion engaged thereby over the insole margin and to press it thereagainst. Each element is also mounted for limited pivotal movement, independently of the element(s) adjacent thereto, about a first axis extending transversely of the last bottom, and also about a second axis extending lengthwise of said last bottom, the arrangement being such that the distance between the second axis and the work-engaging surface of the element, along a perpendicular to said surface passing through said second axis, is equal, or substantially equal, to the distance between the first axis and a reference plane, in which the second axis lies and which extends parallel to said first axis, along a perpendicular to said reference plane passing through said first axis.

The first axis lies in the plane of the work-engaging surface of the wiping element, when that surface lies parallel with the reference plane. In this condition of the work-engaging surface, the first axis coincides with the longitudinal center line of said surface. Thus, with the wiping element in such position, pivotal movement thereof can take place without significantly varying the spacing between the work-engaging surface of adjacent elements, providing a substantially continuous wiping surface. As the wiping element is pivoted about its second axis out of the aforementioned position, the pivotal movement thereof about the first axis will tend to create a stepped, rather than a continuous wiping surface, however, this stepped effect will not be significant in the majority of cases, since the effect of the in-wiping movement of the wiping elements is to cause the wiping elements to be "cammed" into or towards the aforementioned position by engagement with the shoe bottom.

The second axis referred to above is preferably arranged at or near the end, closer to the last support, of the wiping element. In this way, the "camming" effect referred to above is heightened and further this positioning of the second axis serves to ensure that the work-engaging surface of the element makes effective contact, over a significant area, with the lasting margin during the lasting operation. To further enhance such contact between the work-engaging surface of the element and the lasting margin, the inward movement of each element can be adjusted independently of the other element. Each wiper element may be provided with spring means associated therewith for urging the element downwardly about the second axis whereby, when the machine is in use, to press the work-engaging surface of the element against the lasting margin of the shoe upper being operated upon.

Each wiping element is also mounted on an arm itself mounted for pivotal movement, independent of the arm adjacent thereto, about a third axis, which extends lengthwise of the last bottom, whereby the wiping element is capable of heightwise movement bodily towards and away from the last bottom. Furthermore, the arm is mounted for pivotal movement about the first axis also and supports the wiping element for pivotal movement about the second axis.

Resilient means may be provided for urging the arm about said third axis, and thus urging the wiping element towards the last bottom. The wiping elements are arranged in pairs, each pair or arms being movable, independently of the pair of arms adjacent thereto, towards and away from the last support and having associated therewith a pad member which serves to clamp an upper against the last over which it is positioned and which is carried by the last support. Each side lasting assembly is mounted for bodily pivotal movement about an axis extending transversely of the bottom of a last supported by the last support. The machine comprises, in addition to the side lasting assemblies, a heel band and heel seat wiper members, forming a substantially continuous wiping surface by which the portions of the lasting margin to be lasted are operated upon, the axis about which each side lasting assemably can pivot as aforesaid extends through the edge of the heel seat wiper members adjacent said assembly in the plane of the work-engaging surface of the heel seat wiper members.

To provide a continuous clamping surface, the pad member associated with the pair of wiper elements of each assembly adjacent the heel seat wiper members extends beneath its adjacent heel seat wiper member and is juxtaposed to the heel band.

It will be appreciated that, using a machine as set out above, the side lasting assemblies can be accommodated to the contour of the shoe bottom, regardless of the height of the heel, while maintaining a continuous, or substantially continuous, wiping surface for operating on the side portions of the shoe bottom.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENT

The machine in accordance with the invention and now to be described is a combined heel seat and side lasting machine comprising a last support 10 (of a generally conventional type, not shown in FIGS. 2 and 3, for the sake of clarity) on which a last can be supported, bottom uppermost, with an insole I located on the bottom thereof and a shoe upper U positioned thereon. The machine further comprises heel seat wiping instrumentalities, including heel seat wipers 12 (again of conventional construction and operation) and a heel band 14, and also two side lasting assemblies generally designated 16, arranged forwardly of the heel seat lasting instrumentalities, one at either side of the last support 10. The side lasting assemblies are mirror opposites one of the other, and the left-hand assembly will not be described with reference to FIGS. 2, 3 and 4.

Figure 3:
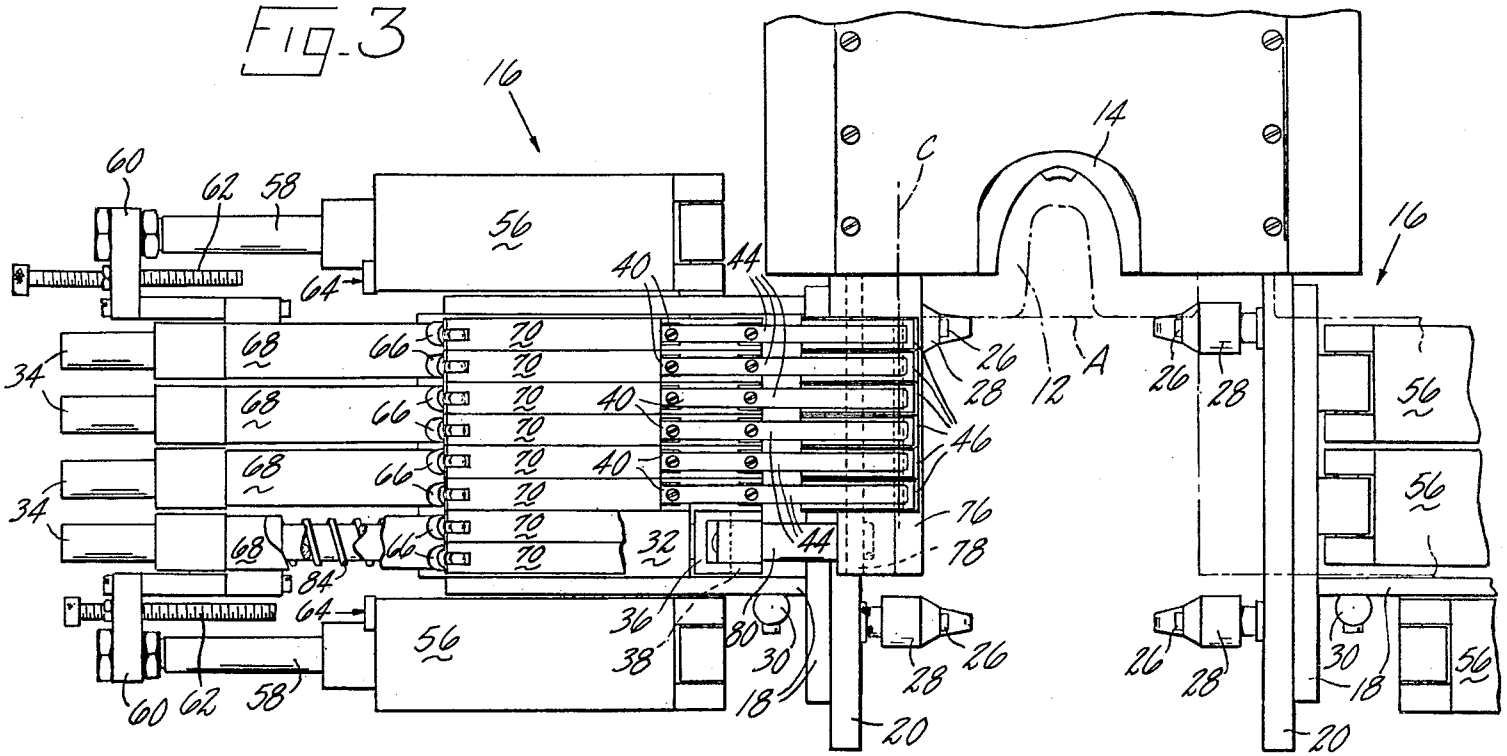
FIG. 3 is a plan view of parts of the machine shown in FIG. 2.
Figure 4:
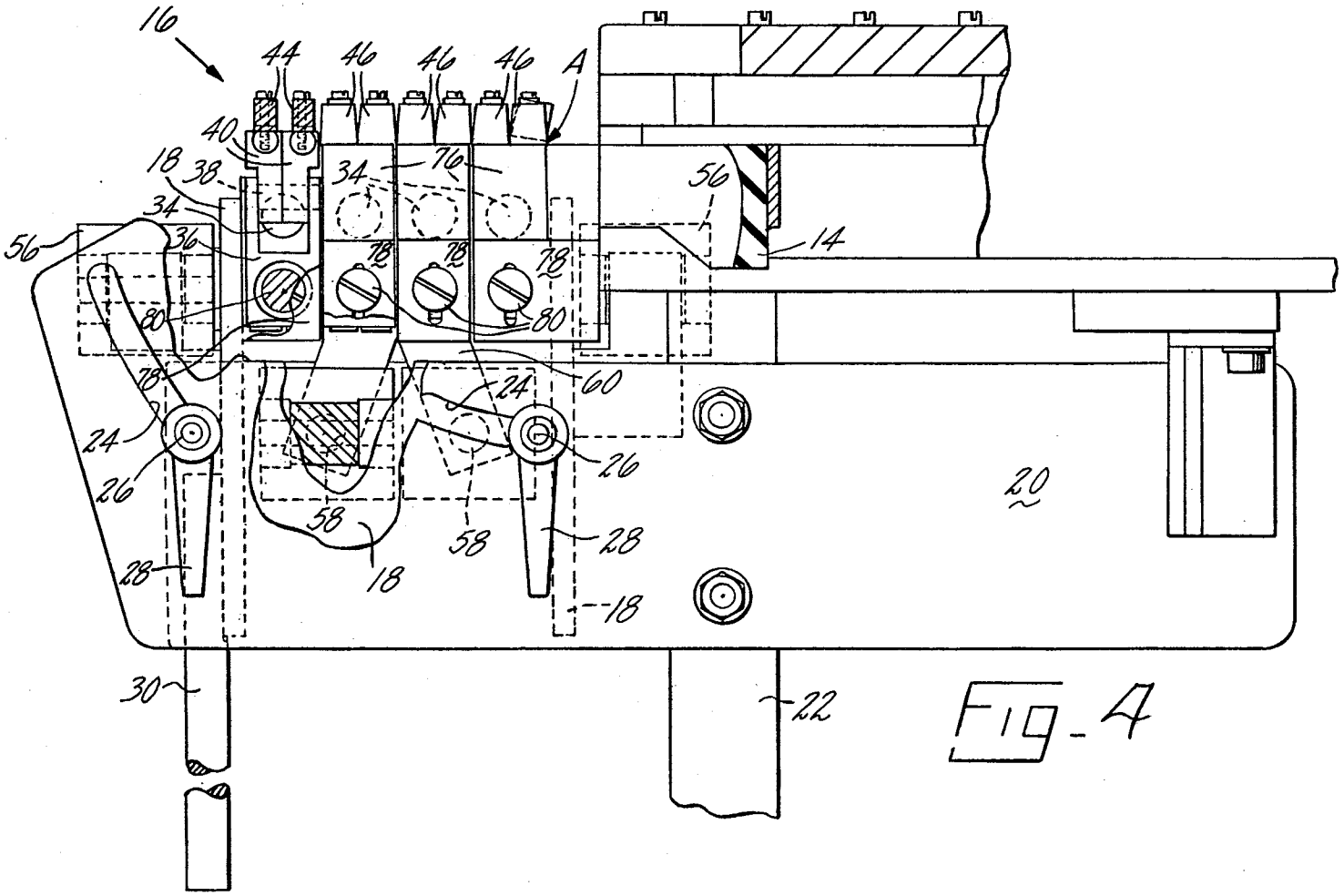
FIG. 4 is a section view showing details of the left-hand side lasting assembly.

The side lasting assembly 16 comprises a sub-frame 18 carried on a forwardly extending plate 20 secured to a portion of a main machine frame 22. Each plate 20 has a slot arrangement 24 each of which may receive a bolt 26 carried by the sub-frame 18, the bolts being provided with clamping handles 28 for locking the sub-frame 18 in adjusted position. The slots 24 are arranged so that the side lasting assembly 16 can pivot bodily about an axis A (as shown in FIGS. 3 & 4) extending through the leading edge of the heel seat wipers 12, when in their advanced condition (not shown), in the plane of the work-engaging surface thereof. A long handle 30 is provided on the front of the sub-frame 18 for pivoting the sub-frame, when it is released by the clamping handles 28.

Four blocks 32, forming part of the sub-frame 18 are arranged side-by-side and fore-and-aft of the machine, each block 32 accommodating a push-rod 34 for sliding movement in a direction transversely of the bottom of a last L carried by the last support 10. At the end, nearer the last support 10, of each push-rod 34 is a block 36 carrying a pivot pin 38 on which a pair of levers 40 are supported for pivotal movement about an axis extending lengthwise of the last bottom.

Figure 1:
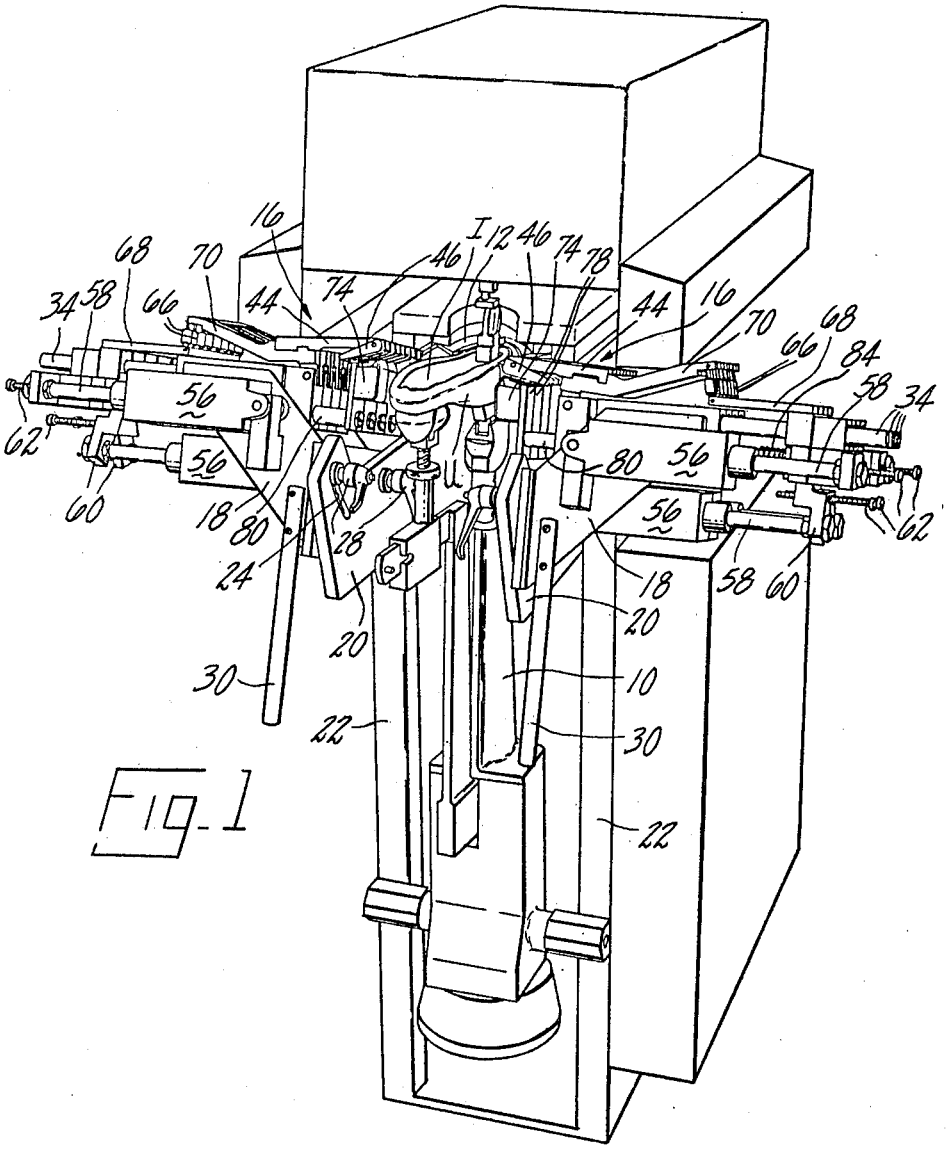
FIG. 1 is a front perspective view of the machine constructed in accordance with the invention.
Figure 2:
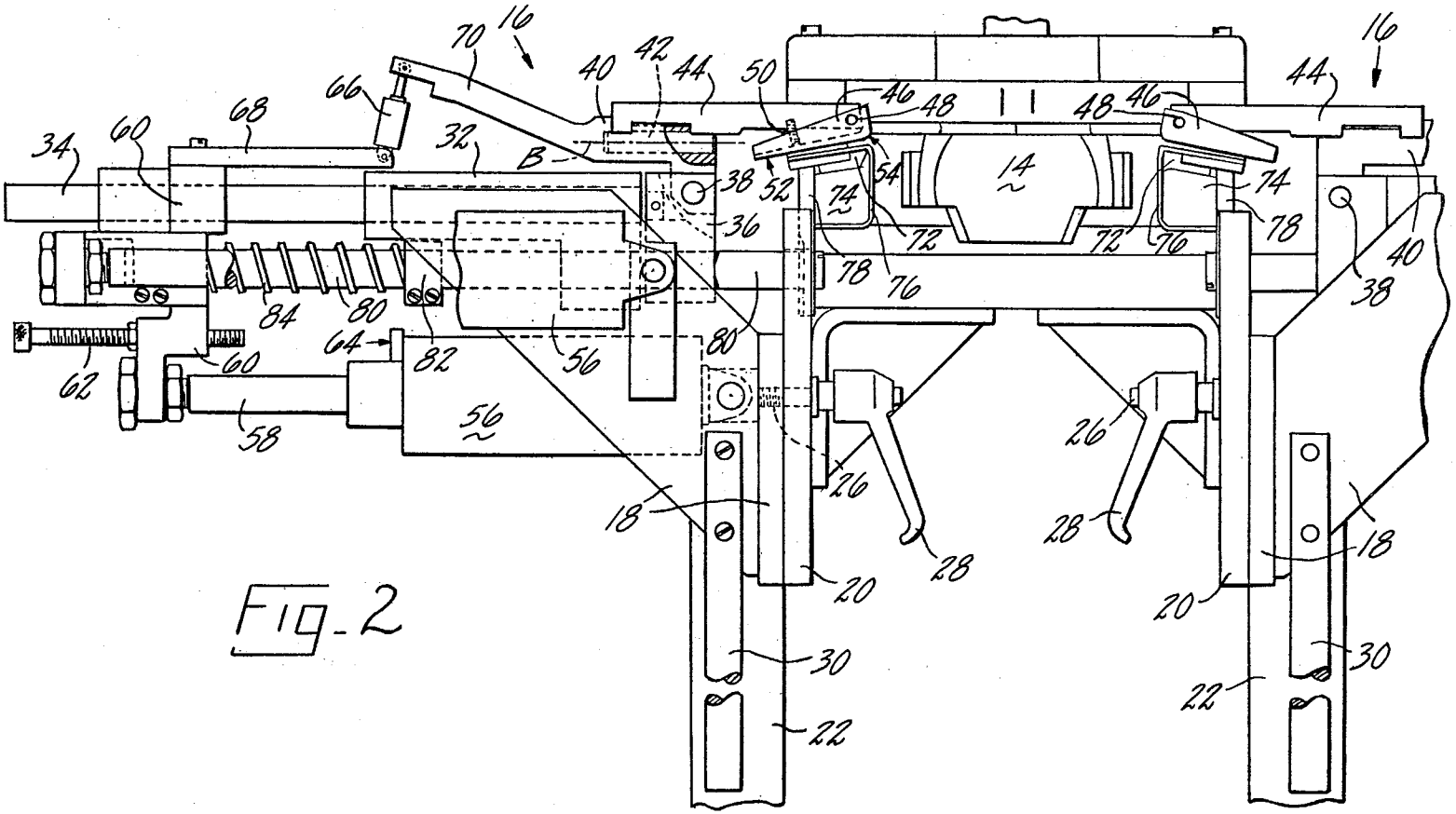
FIG. 2 is a front elevational view, with parts broken away, of the machine, showing details of a side lasting assembly thereof.

Each lever 40 supports a further pivot pin 42, having an axis B, which extends transversely of the last bottom, said pin 42 carrying an arm 44 for supporting a wiping element 46 which serves to wipe the lasting margin of the upper U over the last bottom and secure it to the insole I. Each side lasting assembly 16 comprises eight such wiping elements. Each wiping element 46 is supported on the arm 44 by a pivot pin 48, having an axis C which extends lengthwise of the last bottom, the pin being arranged at or near the end of the wiping element closer to the last support. A spring 50 urges the wiping element 46 downwardly about the pivot pin 48 (counter-clockwise, as shown in FIG. 2). The wiping element 46 has a flat work-engaging surface 52 with a curved lead-in portion 54 at the end of the element closest to the last support.

The wiping element 46, arm 44 and pivot pins 42 and 48 are so arranged that the distance between the axis C of the pin 48 and the flat work-engaging surface 52, along a perpendicular to said surface passing through the axis C, is equal, or substantially equal, to the distance between the axis B of the pin 42 and a reference plane in which the axis C lies and which extends parallel to the axis B, along a perpendicular to said reference plane passing through the axis B. In this way, when the work-engaging surface 52 of the wiping element 46 lies parallel to said reference plane, the axis B lies in the plane of said surface 52. Furthermore, in this condition of the surface 52, the axis B is arranged to coincide with the longitudinal center line of said surface. Furthermore, the height of the wiping elements 46 may be adjusted, by means of the slots 24 as above described, so that the axis B passes through the portion 52 (or 54) of the work-engaging surface of the wiping element which first engages the shoe upper U during an in-wiping movement of the element 46.

Each push-rod 34 has a piston-and-cylinder arrangement 56 associated therewith for effecting the in-wiping movement of the wiping elements 46. Each side lasting assembly 16 thus comprising four such arrangements. A piston-rod 58 of each such arrangement is connected to the push-rod through a bracket 60, which is clamped on the push-rod. In order to limit the amount of in-wiping movement of each pair of wiping elements 46, the bracket 60 carries an adjustable stop screw 62 arranged to engage with an abutment face 64 on the piston-and-cylinder arrangement 56.

As already mentioned, each lever 40 can pivot about its pivot pin 38. Resilient means, in the form of a further piston-and-cylinder arrangement 66 is provided which is supported by a bracket 68 mounted on the bracket 60 and acts on an extension 70 of the lever 40. Each bracket 68 thus supports two further piston-and-cylinder arrangements 66.

In the operation of the lasting machine, as the wiping elements 46 effect an in-wiping movement, a first pressure is applied to the further piston-and-cylinder arrangements 66, and thereafter, a second pressure, constituting a bedding pressure is applied thus to press the wiped-over lasting margin of the upper U against the insole I.

Each further piston-and-cylinder arrangement 66 is double-acting and, in the operation of the machine, after the bedding pressure has been applied as aforesaid, pressure is applied to the opposite side of the piston of the arrangement 66 to lift the wiping element 46 out of engagement with the lasting margin, thereby to facilitate the removal of the lasted shoe from the machine.

A clamp pad comprising a hard rubber shaped block 72 is associated with each pair of wiping elements and, arranged therebeneath, is a block 74 of softer resilient material, the two blocks being covered by a liner 76 of leather. The leather liner 76 provides the work-engaging surface of the clamp member. The lasting assembly 16 should be pivoted bodily as aforesaid so as to ensure that the hard rubber blocks 72 engage the shoe in the featherline region thereof. The blocks 74 should be sufficiently soft and resilient to enable them to conform to the side contours of the last, while clamping the upper thereagainst.

Each clamp member is movable, in a direction extending transversely of the last bottom, into and out of an operative position in which it engages with a shoe. To this end, each clamp member is mounted on a plate 78 carried on a push-rod 80 accommodated at one end in the plate 20 and at the other in the bracket 60, a central part of said rod being supported in a bore in the block 32. Encircling each push-rod 80, and acting between the bracket 60 and a collar 82 secured to the push-rod, is a spring 84 of the heavy compression type. In the operation of the machine, when the bracket 60 is moved to move the wiping elements 46 towards the shoe, the spring 84 acts on the collar 82 to move the rod 80, and thus the clamp member supported thereon, also towards the shoe. After engagement of the shoe by the clamp member, continued movement of the bracket 60, under the influence of the piston-and-cylinder arrangement 56, is effective to cause the in-wiping movement of the wiping elements 46 to continue, while the spring 84 is compressed, thereby enhancing the pressure of the clamp member on the shoe further.

As can be seen especially in FIG. 4, the clamp member associated with the wiping elements 46 adjacent the heel seat wipers 12 extends beneath the latter, when they are in their forward condition, and is juxtaposed to the heel band 14. In this way, a continuous clamping surface is provided by the clamp members and the heel band around the whole area of the shoe to be lasted. Furthermore, by providing for the wiping elements 46 to pivot each about their axis B, which in one condition lies in the plane of the work-engaging surface 52 thereof, the wiping elements can provide a substantially continuous wiping surface, while conforming to the contour of the last bottom. To facilitate such pivotal movement of the wiping elements 46, as can be seen in FIG. 4, side faces thereof are chamfered so as to prevent adjacent elements from "binding" one against the other during the pivotal movement thereof. It will further be appreciated that, by mounting each wiping element 46 for independent pivotal movement, in the manner described above, the facility for conforming to the contour of the last bottom is significantly enhanced.

Though the invention has been specified above with a certain degree of particularity, it is intended that the appended claims be interpreted as exemplary only, and not in a limiting sense.

Having thus described my invention, what I claim as new and desire to secure by Letters Patent of the United States is:

1. A shoe machine for use in the lasting of side portions of shoe uppers, said machine comprising;

a support for a shoe last on which an upper, the side portions of which are to be lasted, and an insole are positioned, and a pair of side lasting assemblies arranged so as to act on opposite side portions of an upper placed on a last supported by said support;

each side lasting assembly comprising a plurality of wiping elements arranged side-by-side so as to engage a corresponding side portion of the upper along the length thereof;

said wiping elements being movable inwardly so as to wipe the upper portion engaged thereby over the insole margin and to press it thereagainst, each element also being mounted for limited pivotal movement independently of the element adjacent thereto about a first axis extending transversely of the last bottom, and also about a second axis extending lengthwise of said last bottom, the arrangement being such that the distance between the second axis and the work-engaging surface of the element along a perpendicular to said surface passing through said second axis is generally equal to the distance between the first axis and a reference plane in which the second axis lies and which extends parallel to said first axis, along a perpendicular to said reference plane passing through said first axis.

2. A shoe machine for use in lasting the side portions of shoe uppers as recited in claim 1 wherein the first axis coincides with the longitudinal center line of the work-engaging surface of said wiping element, when said surface lies parallel to said reference plane.

3. A shoe machine for use in lasting the side portions of shoe uppers as recited in claim 1 wherein said second axis is arranged in the vicinity of the end of said wiping element closest to said last support.

4. A shoe machine for use in lasting the side portions of shoe uppers as recited in claim 3 wherein the inward movement of each element can be adjusted, independently of the other element.

5. A shoe machine for use in lasting the shoe portions of shoe uppers as recited in claim 3 wherein each wiping element has a spring means associated therewith for urging said element downwardly about the second axis when the machine is in use, to press the work-engaging surface of said element against the lasting margin of a shoe upper being operated upon.

6. A shoe machine for use in lasting the side portions of shoe uppers as recited in claim wherein each wiping element is mounted on an arm itself mounted for pivotal movement, independently of the arm adjacent thereto, about a third axis, which third axis extends lengthwise of the last bottom, whereby the wiping element is capable of heightwise movement bodily towards and away from the last bottom.

7. A shoe machine for use in lasting the side portions of shoe uppers as recited in claim 6 wherein a resilient means is provided whereby each arm can be urged about the third axis and each wiping element can thus be urged towards the last bottom.

8. A shoe machine for use in lasting the side portions of shoe uppers as recited in claim 7 wherein each of said resilient means comprises a piston-and-cylinder arrangement, said piston-and-cylinder arrangements forming part of a pneumatic circuit by which the pressure of the fluid admitted to said piston-and-cylinder arrangements can be regulated, said piston-and-cylinder arrangements being such that a first pressure is applied during the in-wiping movement of said wiper elements, and thereafter a second pressure is applied, constituting the bedding pressure.

9. A shoe machine for use in lasting the side portions of shoe uppers as recited in claim 8 wherein each resilient means is effective, at the end of a lasting operation, to cause its associated wiping element to be urged to an inoperative condition away from said last support.

10. A shoe machine for use in lasting the side portions of shoe uppers as recited in claim 8 wherein said arms, and thus said wiping elements, are arranged in pairs, each pair of arms being movable, independently of any pair of arms adjacent thereto, towards and away from said last support, and having associated therewith a pad member which serves to clamp an upper against said last over which it is positioned and which is carried by said last support.

11. A shoe machine for use in lasting the side portions of shoe uppers as recited in claim 10 wherein each pair of arms has associated therewith a fluid pressure operated means for moving such pair, and thus also said pad member associated therewith, towards said last support, said fluid pressure operated means being effective, through a fixed connection, to move said pair of arms associated therewith towards said last support and also, through a yielding connection, to move said pad member into clamping engagement with an upper as aforesaid, additionally, after said pad member has clampingly engaged said upper as aforesaid, and its movement has thus been arrested, movement of said wiping elements may continue thus to effect the in-wiping of the lasting margin.

12. A shoe machine for use in lasting the side portions of shoe uppers as recited in claim 11 wherein an adjustable stop means may be provided, associated with each pair of wiping elements, wherein the in-wiping movement of said pair may be regulated.

13. A shoe machine for use in lasting the side portions of shoe uppers as recited in claim 12 wherein each side lasting assembly is mounted for bodily pivotal movement about an axis extending transversely of the bottom of a last supported by said last support.

14. A shoe machine for use in lasting of heel seat and side portions of shoe uppers as recited in claim 13 comprising, in addition to said side lasting assemblies, a heel band and heel seat wiper members, wherein said heel seat wiper members and said wiping elements of the side lasting assemblies together form a substantially continuous wiping surface by which the portions of the lasting margin to be lasted are operated upon.

15. A shoe machine for use in lasting the side portions of shoe uppers as recited in claim 14 wherein the axis about which each side lasting assembly can pivot extends through the edge of the heel seat wiper members adjacent said assembly in the plane of the work-engaging surface of the heel seat wiper members.

16. A shoe machine for use in lasting the side portions of shoe uppers as recited in claim 14 wherein said pad member associated with the pair of wiping elements of each assembly adjacent the heel seat wiper members extends beneath its adjacent heel seat wiper member and is juxtaposed to the heel band.

* * * * *

UNITED STATES PATENT OFFICE

CERTIFICATE OF CORRECTION

Patent No. 4,296,513 Dated October 27, 1981

Inventor(s) David W. Halford, Frank C. Price, George H. Bosworth

It is certified that error appears in the above-identified patent and that said Letters Patent are hereby corrected as shown below:

Claim 6 - Line 25, after "claim" insert -5-

Signed and Sealed this

*Twenty-third* Day of *March 1982*

[SEAL]

*Attest:*

GERALD J. MOSSINGHOFF

*Attesting Officer*

*Commissioner of Patents and Trademarks*